US008341803B2

(12) United States Patent
Gardner et al.

(10) Patent No.: US 8,341,803 B2
(45) Date of Patent: Jan. 1, 2013

(54) FLOOR CLEANING ATTACHMENT

(75) Inventors: Michael R. Gardner, Anderson, SC (US); Klaus K. Hahn, Braselton, GA (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 715 days.

(21) Appl. No.: 12/429,633

(22) Filed: Apr. 24, 2009

(65) Prior Publication Data

US 2009/0265876 A1 Oct. 29, 2009

Related U.S. Application Data

(60) Provisional application No. 61/048,044, filed on Apr. 25, 2008.

(51) Int. Cl.

| | |
|---|---|
| ***A47L 7/00*** | (2006.01) |
| ***A47L 5/00*** | (2006.01) |
| ***A47L 5/14*** | (2006.01) |
| ***A47L 5/16*** | (2006.01) |
| ***A47L 5/10*** | (2006.01) |
| ***A47L 5/26*** | (2006.01) |
| *A47L 9/02* | (2006.01) |

(52) U.S. Cl. ..... 15/322; 15/409; 15/320; 15/330; 15/345; 15/387

(58) Field of Classification Search ..... 15/409, 15/320, 322, 330, 345, 387, 419
See application file for complete search history.

(56) References Cited

U.S. PATENT DOCUMENTS

| | | | | |
|---|---|---|---|---|
| 3,324,499 | A * | 6/1967 | West | 15/322 |
| 3,808,631 | A * | 5/1974 | Shibata et al. | 15/321 |
| 3,964,123 | A * | 6/1976 | Pettersson | 15/345 |

* cited by examiner

*Primary Examiner* — Bryan R Muller
(74) *Attorney, Agent, or Firm* — Michael Best & Friedrich LLP

(57) ABSTRACT

A floor cleaning attachment is configured to attach to a pressure washer lance to receive a flow of fluid. The floor cleaning attachment includes a housing that defines a suction space and includes an attachment point configured to attach to the pressure washer lance to receive the flow of fluid. A rotatable brush is coupled to the housing, a vacuum producing member is coupled to the housing, and a valve is coupled to the housing and movable between a first position in which the flow of fluid is directed onto a floor, a second position in which the flow of fluid is directed to the vacuum producing member to produce a partial vacuum, and a third position in which the flow of fluid is directed to the rotatable brush to rotate the brush.

13 Claims, 5 Drawing Sheets

FLOOR CLEANING ATTACHMENT

RELATED APPLICATION DATA

This application claims benefit under 35 U.S.C. Section 119(e) of co-pending U.S. Provisional Application No. 61/048,044 filed Apr. 25, 2008, which is fully incorporated herein by reference.

BACKGROUND

The invention relates to a surface cleaner. More particularly, the invention relates to a surface cleaner that uses high pressure water and/or low pressure water.

Surface cleaners are often used to provide a flow of relatively high pressure water upon a surface. Conventional surface cleaners include one or more fluid nozzles that direct fluid onto the surface. Conventional surface cleaners must be fluidly connected to an independent pressure washer or other source of high pressure fluid through a hose, tube, or other conduit. Both the pressure washer and surface cleaner must often be repeatedly and independently moved by the operator when cleaning a large surface. A conventional surface cleaner or pressure washer generally relies on the high pressure fluid to clean a surface, leaving dirty fluid behind, as well as particles that could not be removed by the high pressure fluid.

SUMMARY

In one aspect of the present invention, a floor cleaning attachment for a pressure washer is contemplated. The floor cleaning attachment includes a cleaning head attached to a spray lance. High pressure fluid from the pressure washer may be directed to the cleaning head. The cleaning head may include spray nozzles which may be used to direct a high or low pressure spray to a cleaning surface. In addition, the cleaning head may be used to drive a turbine wheel which is connected to a cylindrical roller brush capable of brushing the cleaning surface. The cleaning head may also direct the high pressure fluid through a venturi to create a suction that enables the cleaning head to remove excess fluid from the cleaning surface.

In one construction, the invention provides a floor cleaning attachment configured to attach to a pressure washer lance to receive a flow of fluid. The floor cleaning attachment includes a housing that defines a suction space and includes an attachment point configured to attach to the pressure washer lance to receive the flow of fluid. A rotatable brush is coupled to the housing, a vacuum producing member is coupled to the housing, and a valve is coupled to the housing and movable between a first position in which the flow of fluid is directed onto a floor, a second position in which the flow of fluid is directed to the vacuum producing member to produce a partial vacuum, and a third position in which the flow of fluid is directed to the rotatable brush to rotate the brush.

In another construction, the invention provides a floor cleaning attachment configured to attach to a pressure washer lance to receive a flow of fluid. The floor cleaning attachment includes a housing defining a suction space and including an attachment point configured to attach to the pressure washer lance to receive the flow of fluid. A spray nozzle is coupled to the housing and positioned to selectively receive a portion of the flow of fluid and direct that fluid onto a floor. A venturi is coupled to the housing and is positioned to selectively receive a portion of the flow of high pressure fluid and to produce a partial vacuum adjacent the suction space in response to the flow of fluid through the venturi. A rotatable brush is coupled to the housing and selectively rotatable in response to selectively receiving a portion of the flow of fluid. A valve is coupled to the housing and is movable to direct the flow of fluid to one of the spray nozzle, the venturi, and the rotatable brush.

In yet another construction, the invention provides a floor cleaning attachment configured to attach to a pressure washer lance to receive a flow of fluid. The floor cleaning attachment includes a housing having a suction space and a valve positioned within the housing and including an inlet that is fluidly connected to the lance to receive the flow of fluid and movable between a first position, a second position, and a third position. A rotatable member is supported for rotation by the housing. A first flow path is positioned at least partially within the housing and extends between the valve and the rotatable member such that the rotatable member rotates in response to flow through the first flow path. A second flow path is positioned at least partially within the housing and includes a venturi positioned to produce a vacuum in the suction space in response to flow through the second flow path. A third flow path is positioned at least partially within the housing and includes an outlet positioned to discharge a flow that passes through the third flow path on to a floor. The valve directs the flow of fluid along the first flow path when in the first position, along the second flow path when in the second position, and along the third flow path when in the third position.

Other aspects and embodiments of the invention will become apparent by consideration of the detailed description and accompanying drawings.

BRIEF DESCRIPTION OF THE DRAWINGS

The invention will be more fully understood and further advantages will become apparent when reference is made to the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
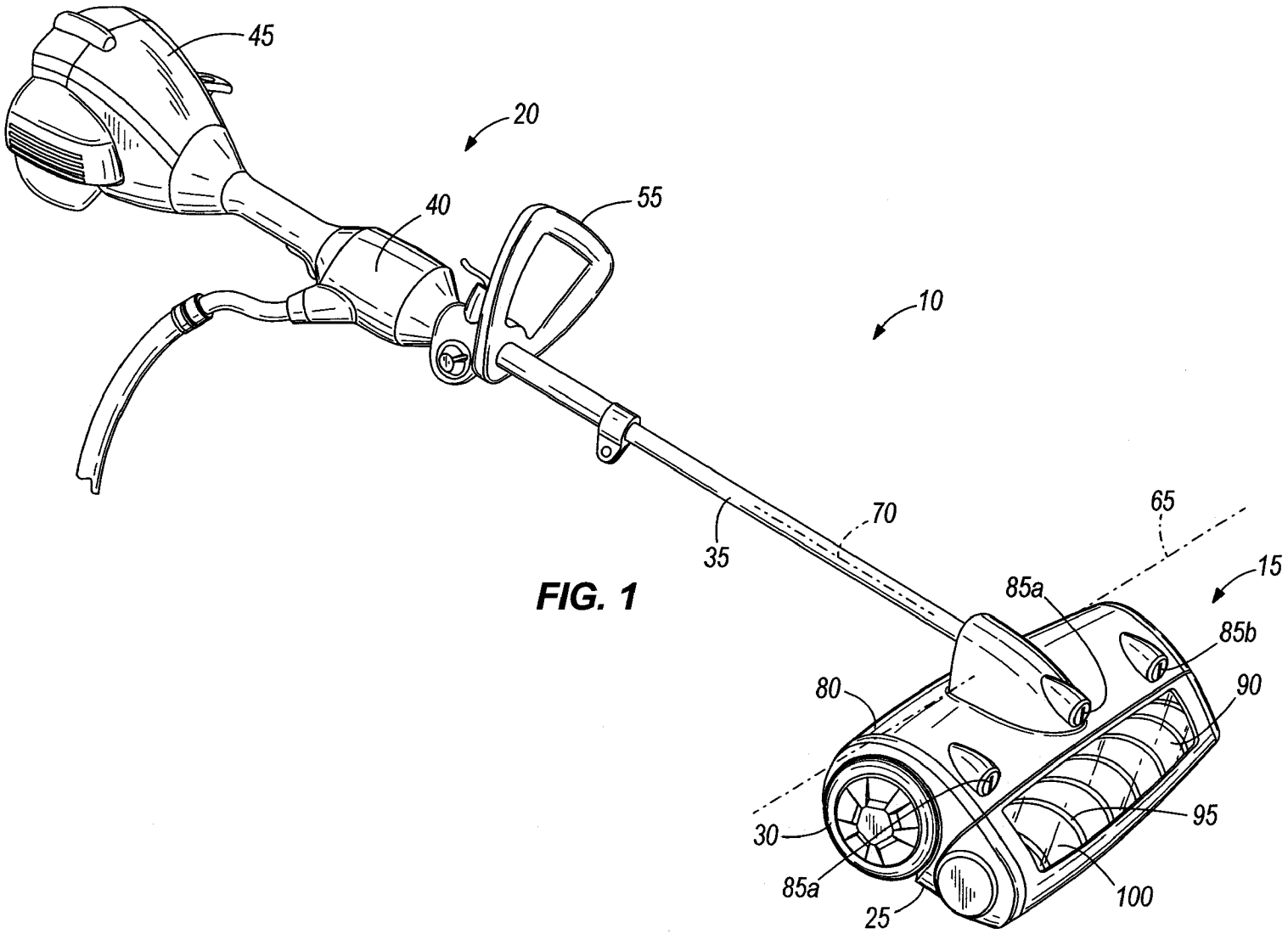
FIG. 1 is a perspective view of a cleaning system including a floor cleaning attachment.

One embodiment of a cleaning system 10 including a floor cleaning attachment 15 is illustrated in FIG. 1. The system 10 includes a pressure washer 20 and the floor cleaning attachment 15 that includes a spray head 25 with wheels 30. The pressure washer 20 includes a lance 35 that attaches to the spray head 25 and acts as a conduit for the delivery of pressurized fluid from the pressure washer 20 to the spray head 25. In some constructions, the pressure washer 20 is replaced with another source of high pressure fluid or is replaced with a low pressure source such as a garden hose.

Figure 6:
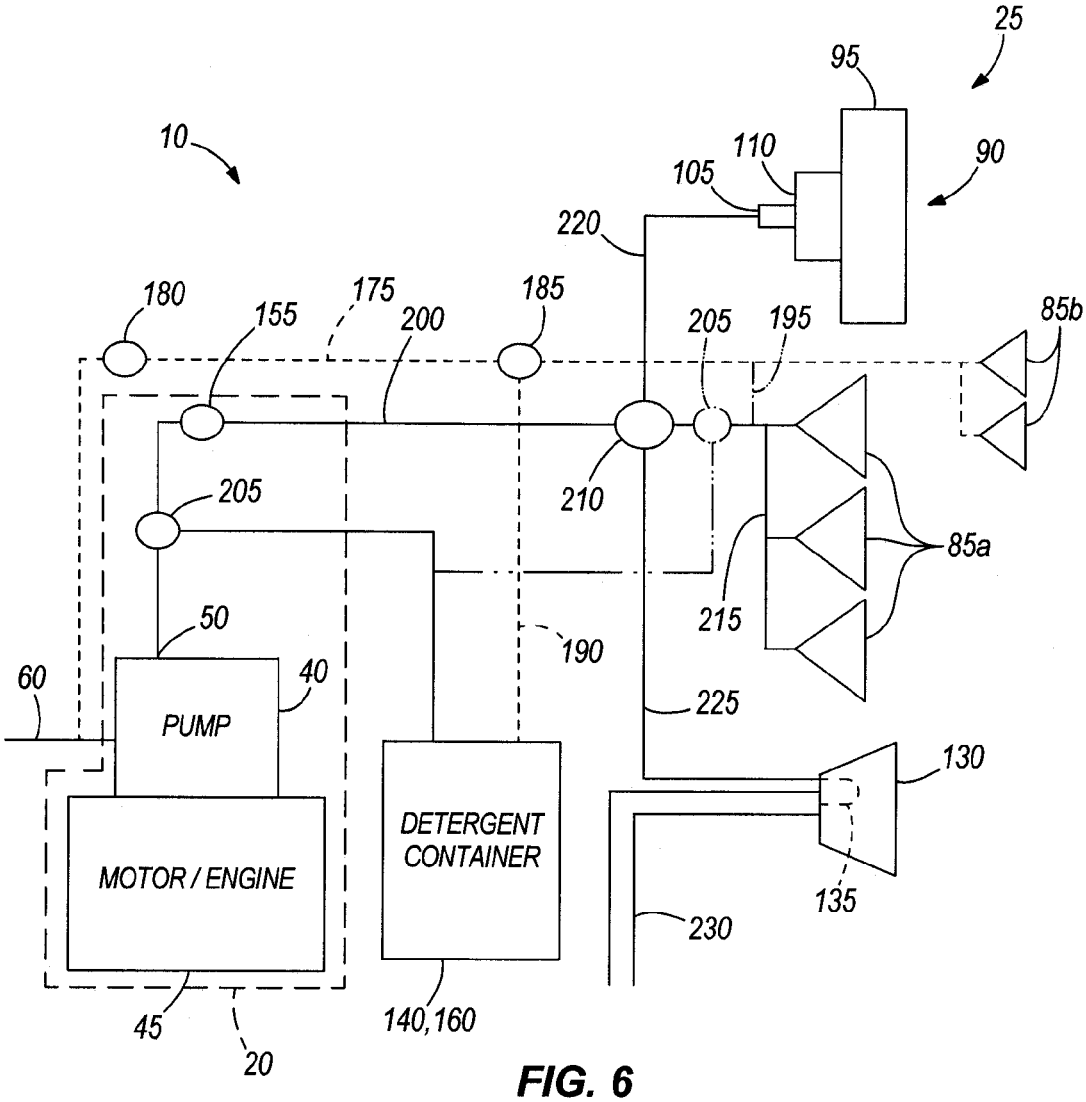
FIG. 6 is a schematic diagram of the operation of the cleaning system including the floor cleaning attachment of FIG. 1, FIG. 2, or FIG. 3.

FIG. 6 schematically illustrates the cleaning system 10 of FIG. 1. The pressure washer 20 includes a pump 40, a prime mover 45, and an outlet 50 that directs fluid to the lance 35. In preferred constructions, the lance 35 includes a handle 55 designed for ergonomic manipulation of the floor cleaning attachment 15 by the user.

The pump 40 includes an inlet 60 (as from a typical garden hose) that takes in low pressure fluid, such as water from a municipal or local source. Alternatively, the water may come from a reservoir that is attached to the pressure washer (e.g., a water tank). The low pressure fluid enters the pump 40 which is powered by the prime mover 45 such as an engine as illustrated in FIG. 6. Alternatively the prime mover 45 may be an electric motor plugged into an outlet or generator. In yet another alternative embodiment, the prime mover 45 may be a battery pack. The pump 40 and prime mover 45 may be any of a variety of pump 40 and prime mover 45 combinations well known in the art of pressure washers 20.

The pump 40 may be one of many different types of positive displacement or centrifugal pumps suitable for providing relatively high pressure flows at relatively constant flow rates. In some embodiments, the pump 40 may include an internal wobble plate (not shown) that is connected to a shaft in rotational connection with a motor shaft. The pump 40 may additionally include a plurality of spring loaded radial pistons that are translatable within respective chambers based on the rotation of the wobble plate. The movement of each respective piston compresses fluid within the piston chamber, causing the fluid pressure within the chamber to increase. Fluid enters the respective piston chamber from the pump inlet 60. The piston chambers may be held shut with spring loaded check valves, which are opened when the fluid within the cylinder exceeds the biasing force of the spring. Piping within the pump 40 directs the fluid leaving the respective cylinder to the pump outlet 50.

In one embodiment, the pump 40 may be capable of providing a fluid flow between about 0.5 to about 5 gallons per minute (gpm), desirably between 0.75 and about 2.5 gpm, more desirably between about 1.0 and about 1.6 gpm. The fluid pump 40 may also provide an outlet pressure at the pump outlet 50 in the range between about 300 psi to about 6000 psi, desirably between about 700 and 3500 psi. As can be understood, the actual flow rate, and outlet pressure through the pump 40 is a function of the incoming flow rate, the diameter of water supply piping, the supply pressure through the fluid inlet 60, as well as numerous other geometrical and fluid dynamic factors. As such, other flow rates and pressures outside of the aforementioned ranges are possible.

As shown schematically in FIG. 6, the pump 40 is powered by an internal combustion engine that is part of the pressure washer 20. The engine includes the motor shaft that is selectively coupled to the pump 40 to transfer the torque generated upon the motor shaft to the pump 40. The engine includes a throttle valve (not shown) which selectively controls the amount of fuel that enters the engine, thereby controlling the speed and related operational characteristics of the engine.

One of ordinary skill in the art will appreciate that there are many ways to connect the spray head 25 to the lance 35 such as with corresponding male and female threaded portions or with a male and female quick connect coupler. A quick connect coupler is commonly known in the art as a coupling having two mating halves used to join two pipes together. Within a quick connect coupling, there is a male plug and a female coupling. To connect the male and female portions, the male plug is inserted into the female coupling. The two portions may be mechanically and fluidly engaged in a variety of ways to prevent leakage, such as twist-on, push-on, or threaded.

The spray head 25 may be pivotably connected to the lance 35 in a manner similar to the standard head of a vacuum cleaner (i.e., such that the spray head 25 pivots about an axis 65 (shown in FIG. 7) that is normal to the lance 35 and parallel to the floor). While there may be some tension in the pivoting connection, the spray head 25 is generally free-floating about its pivoting axis 65. The spray head 25 may be rotated from 0 to 180 degrees or more relative to the long axis 70. In addition, the spray head 25 may be selectively locked at a certain angle relative to the lance 35 with a mechanism similar to that used to lock conventional upright vacuum cleaners into a vertical orientation for transport and storage. The lock may additionally operate in conjunction with an operator controllable override located in a handle 75. The override may be disposed upon the spray head 25 in a position to be easily operated by the user (by either a hand or a foot, or by an independent tool or operator controlled by the user's hand or foot), while also minimizing the complexity of the system to disengage the lock. The override may be operable with a button or lever disposed upon the spray head 25, or another similar mechanical structure. When operated, the override mechanically disengages the lock from the spray head 25 (or structure rigidly mounted thereto) to allow the spray head 25 to freely pivot. The spray head 25 may be fluidly connected to the lance 35 with a flexible and movable conduit disposed within the spray head 25, such as a flexible, high pressure hose, to allow necessary movement thereof as the spray head 25 pivots and the lance 35 remains stationary.

Returning to FIG. 1, the spray head 25 includes a housing 80 that may be made from a plastic or nylon with or without reinforcing internal or external ribs. Alternatively, the housing 80 of the spray head 25 can be made of stainless steel, brass, or other suitable materials with or without ribs. Alternatively, the housing 80 may be constructed in other geometries using suitable materials known in the art.

One or more spray nozzles 85 may be disposed on the spray head 25 for spraying fluid onto the surface in front of the spray head 25. These nozzles 85 can be high pressure nozzles 85*a*, low pressure nozzles 85*b*, a combination thereof, or nozzles suitable for operation at low and high pressures. In some embodiments and as shown in FIG. 1, the nozzles 85 may be disposed on top of the spray head 25. In other embodiments, a different number of nozzles 85 may be provided. In a preferred embodiment, the external nozzles 85 are fan nozzles. However, other constructions may employ nozzles 85 that are pencil nozzles, turbo nozzles, fan nozzles, or the like and any combination thereof. In some constructions, the nozzles 85 are external to the spray head 25, while other constructions position the nozzles 85 within the spray head 25.

The spray head 25 also includes a rotatable member 90 supported by the housing 80 for rotation. In the illustrated construction, the rotatable member 90 includes a cylindrical roller brush 95. In other constructions, other members are employed or more than one rotating brush 95 is employed. In addition, it is preferable that the brush 95 be easily removable and replaceable to allow for the replacement of worn brushes 95 or for the insertion of a different type of brush 95 (e.g., different bristle firmness) that may be more suited to performing the task at hand.

The housing 80 is arranged to cover the top portion of the rotatable member 90 and to support it for rotation. In the construction illustrated in FIG. 1, the housing 80 includes a transparent portion 100 positioned above the rotatable member 90 to allow the user to see a portion of the rotatable member 90 during use. This allows the user to verify the operation of the rotatable member 90 during a cleaning operation.

Figure 4:
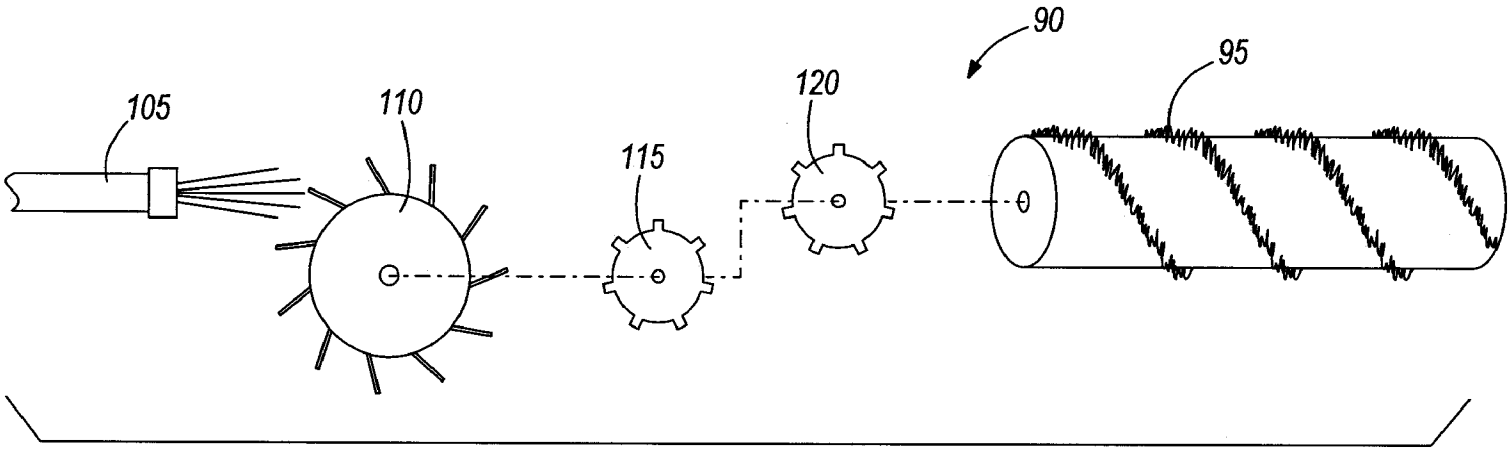
FIG. 4 is a schematic view of the operation of a cylindrical roller brush disposed in the spray head of FIG. 3.

As schematically shown in FIG. 4, the spray head 25 may be configured to operate in a brushing mode where a high pressure spray is directed from a nozzle 105 towards the rotatable member 90 and specifically toward a water turbine wheel 110 which in turn may be connected to a gear system 115, 120 mechanically connected to the cylindrical roller brush 95. The gear system 115, 120 may be adjusted by altering the gear ratios to produce the desired rotational speed and torque upon the cylindrical brush 95 with the normal fluid pressure within the system 10. One of ordinary skill in the art will appreciate that a variety of methods can be used to transfer energy from the water turbine wheel 110 to the cylindrical brush 95, including but not limited to the use of a belt system, gear system, direct drive, and the like.

In this brushing mode, the turbine 110 drives the gear system 115, 120 or other type of transmission, and enables the roller brush 95 to rotate either forward or backward to clean the surface, depending on how the gear system 115, 120 is configured. In an alternative embodiment, two cylindrical roller brushes may be used. In another alternative embodiment, the two cylindrical roller brushes may be counter-rotating. In addition, while in brushing mode, a liquid spray may also be directed onto the surface, preferably forward of the cylindrical roller brush 95.

Figure 5:
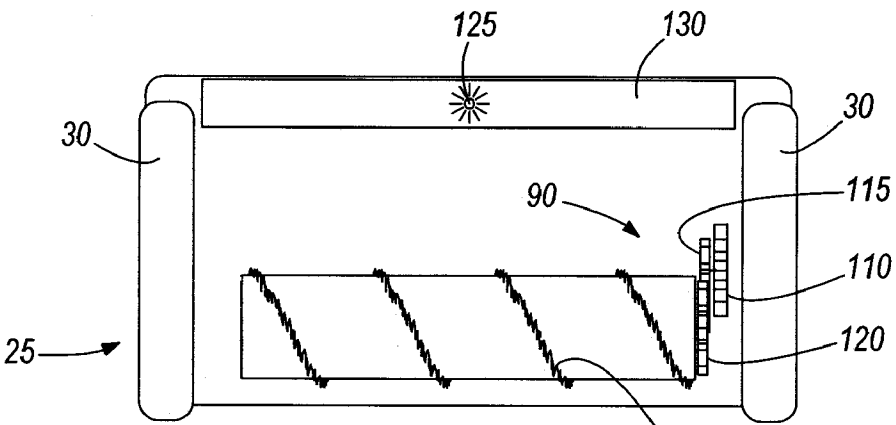
FIG. 5 is a bottom plan view of the spray head of FIG. 3.

In yet another mode, the high pressure flow can be directed in such a way as to impart a vacuum to the liquid on the surface to be cleaned, thus causing a sucking action. A view of the spray head 25 from below is shown in FIG. 5. A venturi vacuum suction port 125 is located preferably at the rear of the spray head 25 within a suction space 130 formed by the housing 80 or positioned within the housing 80 to suction excess water or detergent solution from the surface being cleaned. The venturi vacuum suction port 125 imparts suction by directing a high velocity flow through a suction venturi 135 (shown in FIG. 6) which is connected to the port 125. The low pressure created at the throat of the suction venturi 135 enables the suction port 125 to act as a vacuum under these conditions. In this embodiment, the high pressure fluid is discharged along with any other liquid collected by the suction port 125.

Thus, the spray head 25 may be capable of spraying, brushing, and sucking water on to and off of a surface. When in spraying mode, the spray head 25 simply sprays a high pressure spray from its nozzles 85*a* onto the surface to be cleaned. In an alternative embodiment, the spray directed from the nozzles 85*b* can be a low pressure spray as from a typical garden hose that receives water from a municipal or local water service. In another alternative embodiment, the pressure of the fluid coming from the pressure washer 20 may be adjustable with a valve. The nozzles 85 may be fixed within the spray head 25 such that they are not adjustable. In an alternative embodiment, the nozzles 85 may be rotatable to adjust the position of the spray onto the surface. The nozzles 85 are preferably located forward of the axis of rotation of the wheels 30, and can be located either forward or rearward of the cylindrical roller brush 95.

Figure 2:
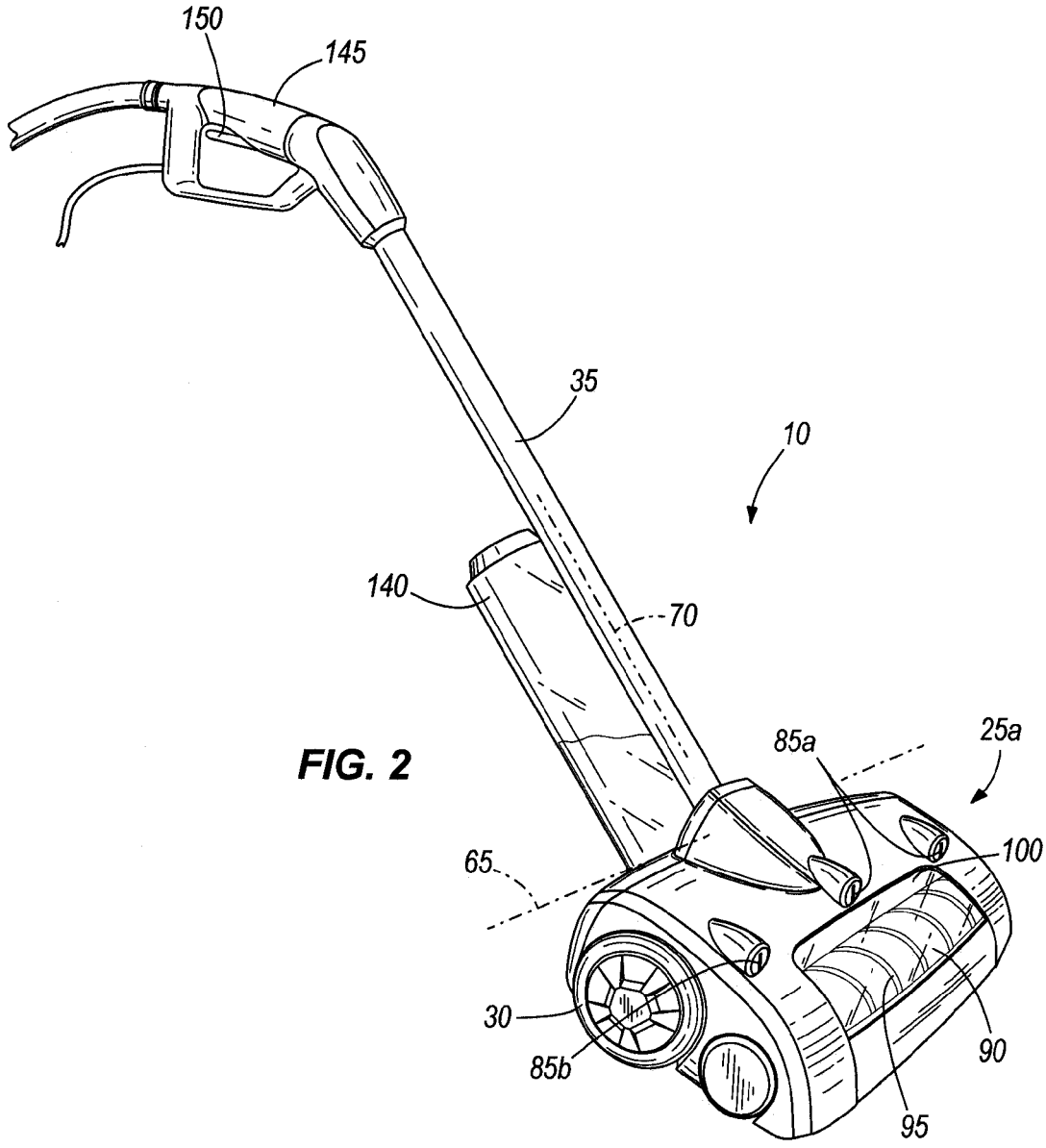
FIG. 2 is a perspective view of another cleaning system including another floor cleaning attachment.

FIG. 2 depicts a construction similar to that of FIG. 1 but further including a built-in detergent solution tank 140 that is incorporated into the back of a spray head 25*a* and secured to the underside of the lance 35. The tank 140 may be in selective fluid communication with the spray head 25*a*, an isolation valve, a venturi, or other selective structure. FIG. 2 also depicts an alternative handle 145 which may have a trigger 150 that when actuated manipulates an actuator valve 155 to allow pressurized fluid to flow to the spray head 25*a*.

Figure 3:
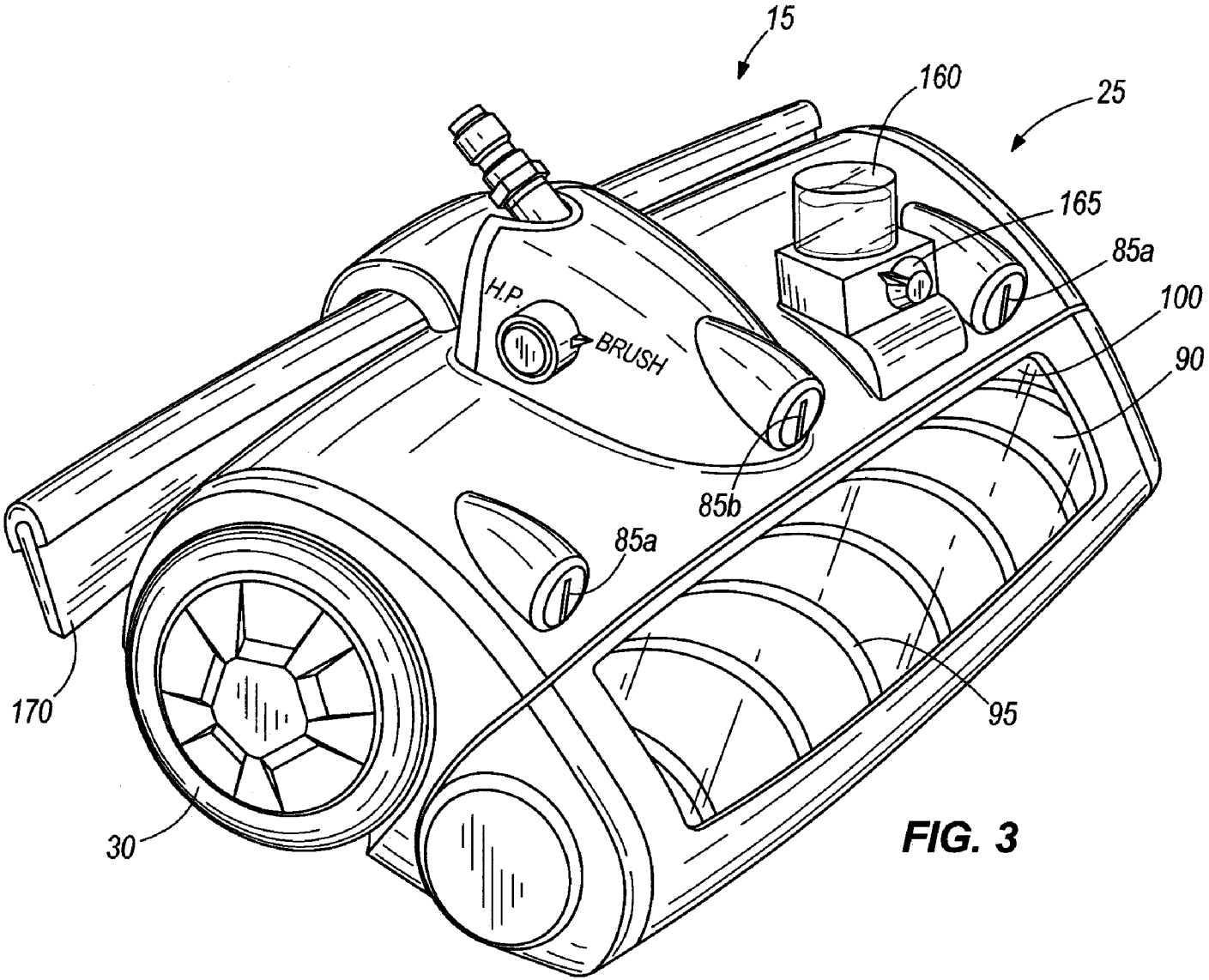
FIG. 3 is a perspective view of a cleaning attachment in the form of a spray head suitable for use with the cleaning system of FIG. 1 or FIG. 2.

FIG. 3 depicts a spray head 25*b* that includes a built-in detergent solution tank 160 disposed on top of the spray head 25*b*. The tank 160 may be in selective fluid communication with the spray head 25*b*, an isolation valve 165, a venturi, or other selective structure. The construction of FIG. 3 also includes a rear squeegee 170 that is attached to the spray head 25*b* and positioned opposite the brush 95. The rear squeegee 170 may be used on surfaces to clear excess water or detergent solution from the surface, and could be attached to other spray heads 25, 25*a* if desired.

FIG. 6 provides a schematic view for the function of the cleaning system 10. A low pressure flow path 175 (shown in broken lines) extends from the low pressure inlet 62 and includes a valve 180 that controls the flow of low pressure fluid to the low pressure spray nozzles 85*b*. A low pressure venturi 185 may be positioned within the low pressure flow path 175 to draw another fluid such as a detergent into the low pressure flow path 175. A suction line 190 extends from a throat of the low pressure venturi 185 to the detergent container 140, 160 such that flow through the low pressure venturi 185 produces a partial vacuum that draws detergent into the venturi 185 and into the low pressure flow path 175. The low pressure flow then proceeds to the low pressure nozzles 85*b*. In constructions that employ only one set of nozzles 85, the low pressure nozzles 85*b* are eliminated and the low pressure flow follows an alternative connection 195 to the nozzles 85*a*.

With continued reference to FIG. 6, a high pressure flow path 200 begins at the pump outlet 50. The actuator valve 155 may be positioned in the high pressure flow path 200 to prevent flow from the pressure washer 20 to the spray head 25. Typically, this valve 155 is part of the pressure washer 20, is supported by the lance 35, and is actuated by the trigger 150.

A high pressure venturi 205 may be positioned between the actuator valve 155 and the pump 40 as illustrated in FIG. 6. The high pressure venturi 205 includes a throat that is connected to the detergent container 140, 160 via a high-pressure suction line 210. High velocity flow through the high pressure venturi 205 produces a low pressure at the throat that draws detergent into the venturi 205 and into the high pressure flow path 200. In an alternative construction, the high pressure venturi 205 is positioned immediately upstream of the nozzles 85*a*. In this position, detergent is only drawn into the flow that is directed to the nozzles 85*a*, thereby reducing wasted detergent by not directing detergent to the brush 95 or to the suction venturi 135.

After the high pressure fluid passes through the actuator valve 155, the flow proceeds to a changeover valve 210. The changeover valve 210 is movable to a first position to direct fluid along a first flow path 215, a second position to direct fluid along a second flow path 220, and a third position to direct fluid along a third flow path 225. When the valve 210 is in the first position, the fluid is directed along the first flow path 215 to the spray nozzles 85*b* such as those shown in FIGS. 1-3. When the valve 210 is in the second position, the flow passes along the second flow path 220 to the water turbine wheel 110 to drive the cylindrical roller brush 95, as depicted in the schematic view of FIG. 4. When the changeover valve 210 is in the third position, the flow passes along the third flow path 225 to the suction venturi 135 to create suction at the suction port 125, then to a discharge hose 230. This enables the siphoning or vacuuming effect in the suction port 125 as depicted in FIG. 5.

The changeover valve 210 may be used to direct the high pressure fluid to any one of the three areas to create a brushing, spraying, or vacuuming effect. In addition, the changeover valve 210 may be configured to direct fluid to a combination of any two of the three locations, or to all three simultaneously.

In operation, the handle 75, 145 or the pressure washer 20 itself may have actuators that enable the user to control the various valves. The actuators can turn the floor cleaning attachment 15 on or off in concert with, or independent of control of other functions of the pressure washer 20 or the floor cleaning attachment 15. In addition, the actuators can determine whether high or low pressure fluid will be used, as well as whether and how much detergent is introduced into the fluid.

It should be noted that, although specific, preferred, and alternative embodiments have been depicted and described, these are to be taken as illustrative and exemplary. It is the appended claims, including all equivalents, which are intended to define the scope of the present invention.

What is claimed is:

1. A floor cleaning attachment configured to attach to a pressure washer lance to receive a flow of fluid, the floor cleaning attachment comprising:

a housing defining a suction space and including an attachment point configured to attach to the pressure washer lance to receive the flow of fluid;

a spray nozzle coupled to the housing and positioned to selectively receive a portion of the flow of fluid and direct that fluid onto a floor;

a venturi coupled to the housing and positioned to selectively receive a portion of the flow of fluid and to produce a partial vacuum adjacent the suction space in response to the flow of fluid through the venturi;

a rotatable brush coupled to the housing and selectively rotatable in response to selectively receiving a portion of the flow of fluid; and a turbine coupled to the rotatable brush and rotatable in response to the flow of fluid.

2. The floor cleaning attachment of claim 1, wherein a portion of the housing is transparent.

3. The floor cleaning attachment of claim 1, wherein the housing accommodates interchangeable cylindrical roller brushes.

4. The floor cleaning attachment of claim 1, further comprising a transmission positioned between the turbine and the rotatable brush and arranged to produce different rotational speeds between the turbine and the rotatable brush.

5. The floor cleaning attachment of claim 4, wherein the transmission includes a plurality of gears.

6. The floor cleaning attachment of claim 1, further comprising a detergent reservoir coupled to the housing and fluidly connected to the spray nozzle for directing detergent onto the floor when fluid is directed to the spray nozzle.

7. The floor cleaning attachment of claim 1, further comprising a squeegee coupled to the housing.

8. A floor cleaning attachment configured to attach to a pressure washer lance to receive a flow of fluid, the floor cleaning attachment comprising:

a housing including a suction space;

an inlet that is fluidly connected to the lance to receive the flow of fluid and movable between a first position, a second position, and a third position;

a rotatable member supported for rotation by the housing;

a first flow path positioned at least partially within the housing and extending between the inlet and the rotatable member such that the rotatable member rotates in response to selective flow through the first flow path;

a second flow path positioned at least partially within the housing and including a venturi positioned to produce a vacuum in the suction space in response to flow through the second flow path; and a third flow path positioned at least partially within the housing and including an outlet for application of flow that passes through the third flow path to a floor; and, a turbine coupled to the rotatable member and rotatable in response to the flow of fluid.

9. The floor cleaning attachment of claim 8, further comprising a transmission positioned between the turbine and the rotatable member and arranged to produce different rotational speeds between the turbine and the rotatable member.

10. The floor cleaning attachment of claim 9, wherein the transmission includes a plurality of gears.

11. The floor cleaning attachment of claim 8, further comprising a detergent reservoir coupled to the housing and fluidly connected to the third flow path for directing detergent onto the floor when fluid is directed to the third flow path.

12. The floor cleaning attachment of claim 8, further comprising a squeegee coupled to the housing.

13. The floor cleaning attachment of claim 8, wherein the rotatable member includes one of a plurality of interchangeable cylindrical roller brushes.

* * * * *